United States Patent [19]

Sadler

[11] 4,164,829

[45] Aug. 21, 1979

[54] INFLATABLE STRUCTURE

[76] Inventor: Philip M. Sadler, 93 Hammond St., Cambridge, Mass. 02138

[21] Appl. No.: 851,432

[22] Filed: Nov. 14, 1977

[51] Int. Cl.[2] ..... E04G 11/04

[52] U.S. Cl. ..... 52/2; 35/42.5; 135/14 D

[58] Field of Search ..... 52/2; 35/42.5; 43; 135/14 D, DIG. 7

[56] References Cited

U.S. PATENT DOCUMENTS

| | | | |
|---|---|---|---|
| 1,975,752 | 10/1934 | Chase et al. | 47/28 |
| 3,159,165 | 12/1964 | Cohen et al. | 52/2 X |
| 3,250,024 | 5/1966 | Douthitt et al. | 52/2 X |
| 3,839,832 | 10/1974 | Kastner | 52/2 |
| 3,898,775 | 8/1975 | Webb | 52/2 |

*Primary Examiner*—C. J. Husar
*Assistant Examiner*—Conrad L. Berman
*Attorney, Agent, or Firm*—Robert F. O'Connell

[57] ABSTRACT

A self-supporting inflatable structure useful, for example, as an inexpensive, readily assembled planetarium, such structure being made of an extensible material having a plurality of panels, each shaped so as to form, when inflated, a hemispherical dome-like structure. A first channel, also made of extensible material is used to supply air, as from an inexpensive, conventional window fan for inflating the structure and a second channel permits the exit of such air in a controlled manner while at the same time acting as an entrance/exit channel for persons using the inflated chamber.

The extensible material is preferably formed of co-extruded, or laminated, opaque plastic sheets, one sheet having a white surface for use as the interior display surface of the planetarium and one sheet being black to prevent light entry into the chamber. The air input and exit channels have a curved configuration which prevents light from entering into the inflated chamber. Such a structure can also be used for many other purposes, both educational or recreational, for example.

14 Claims, 5 Drawing Figures

INFLATABLE STRUCTURE

INTRODUCTION

This invention relates to flexible structures which can be readily inflated and collapsed and, more particularly, to such structures as may be variously used for educational, hobby, or other purposes.

BACKGROUND OF THE INVENTION

In many instances it is desirable to have available a structure which can be readily assembled and disassembled for temporary use and which can be easily stored when not in use. For example, in schools or other institutions such structure could be used for educational purposes as a temporary planetarium for providing instruction in astronomy. Since a permanent planetarium is generally not feasible for most such educational institutions, it is desirable to have available a structure which is relatively inexpensive, can be stored in a relatively small space, and which can be relatively easily assembled for use in a schoolroom, an auditorium, a gymnasium, or the like, on a temporary basis and then readily disassembled and re-stored.

Other exemplary applications of such structures might be as playhouses for children, as darkrooms for photography enthusiasts, or for other purposes both educational or recreational as may be conceived by those in the art.

A prior art structure which has been disclosed for use only as a portable planetarium is described in U.S. Pat. No. 3,250,024, issued on May 10, 1966, to Douthitt et al. As disclosed therein the planetarium is of the inflatable type which employs a self-supporting fabric structure that includes a hemispherical dome having its peripheral edge connected with an upright wall that serves to support the dome with respect to the ground or floor surface upon which the overall unit is placed. The unit is thereupon inflated with air so as to be generally self-supporting, the air pressure being controlled by various baffling means to maintain a substantially constant contour to the inflated planetarium. The interior of the fabric is darkened and made as light-free as possible so that the overall structure can be utilized in a fully lighted room. The structure can be set up and dismantled, as needed, and, when used with a suitable planetarium projector, is intended to provide a relatively accurate representation of a planetarium display.

The structure disclosed in the Douthitt et al. patent appears to require relatively costly fabrication of the elements involved and its complexity appears to make the fabrication and use thereof more complicated than is desirable. Accordingly, no apparent market for such apparatus has been successfully penetrated by the Douthitt et al. apparatus.

It is desirable to make available a unit which can be purchased at much lower cost than that of the Douthitt et al. structure, either by schools and the like or by individuals for home use. Such unit should be capable of substantially complete collapsibility in a manner such that it can be packed in a relatively compact manner so as to take up little space in storage. Further, the unit should be easily assembled and disassembled so that valuable educational time will not be lost in the assembly and disassembly process. Unfortunately, such relatively inexpensive and easy to use structures of this type are not available in the present day marketplace.

BRIEF SUMMARY OF THE INVENTION

In order to fulfill such needs the structure of the invention provides a completely flexible unit which can be fabricated at relatively low cost because of the simplicity of its construction and which can further be readily assembled and disassembled and stored in a relatively small space without difficulty.

In accordance with the invention, the self-supporting structure comprises an extensible material which is capable of being deformed in a concave fashion so as to resemble a hemisphere and which can be inflated with a relatively inexpensive means, such as an ordinary window fan. The structure contains essentially no rigid elements and for that reason is substantially completely collapsible and can be arranged in a very compact package for storage. Further, the openings for introducing air and for permitting entry and exit of individuals can be readily arranged to prevent light leakage, if desired, without the use of baffles and the entry/exit portion of the structure is capable of providing control for the regulation of air flow.

The invention can be understood more clearly with the help of the accompanying drawings wherein.

Figure 1:
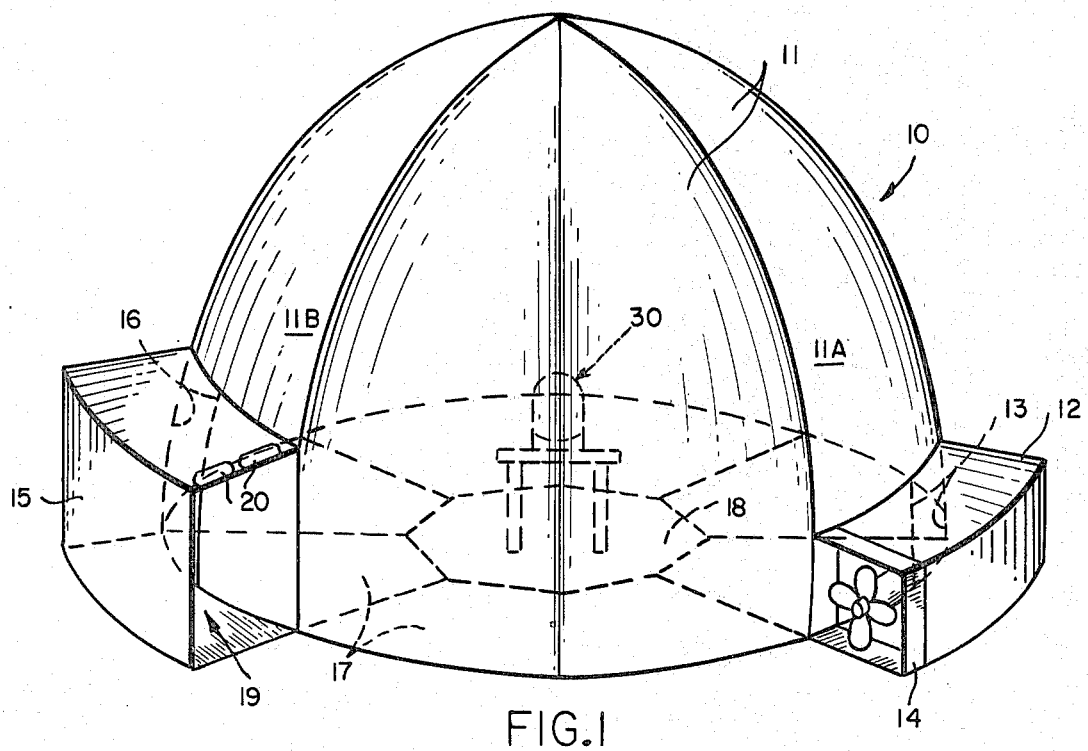
FIG. 1 shows a generally isometric view of a preferred embodiment of an inflatable structure in accordance with the invention.

As can be seen in FIG. 1, the self-supporting inflatable structure 10 utilizes a plurality of flexible panels 11 each of which can have essentially the same shape, each panel being appropriately attached to adjacent panels along coextensive longitudinal edges. Such panels are made of a suitable extensible material, such as co-extruded, composite polyethylene film material comprising two layers. A first layer which faces into the interior of structure 10 has a white surface, while the second layer has a black surface, the overall material being opaque. A useful thickness thereof has been found to lie within a range from about 4 mil. thickness to about 6 mil. thickness. The panels may be attached as by heat sealing the longitudinal edges thereof to form the structure 10. A first panel 11A of the overall panelled structure is arranged to have an opening 13 therein, shown by the dashed lines in FIG. 1. A first flexible channel 12, which is exemplarily shown as having a generally rectangular shape and is also formed from such co-extruded plastic film material, is attached to panel 11A along the channel edges adjacent panel 11A. The co-extruded plastic material used for panels 11 and channels 12 and 15 is generally available from many sources, one such source being the Worcester Slitting And Manufacturing Company, Worcester, Mass.

An appropriate air moving device, such as a conventional window fan 14, is positioned at the opening of channel 12 as shown so that air under pressure greater than atmospheric pressure is propelled into channel 12 and thence through opening 13 into the interior of structure 10 in a manner such as to inflate the composite panel structure and form a generally hemispherical shell. A second channel 15 which can also have a generally rectangular shape is attached to a second panel 11B which is generally located opposite panel 11A. Panel 11B has an opening 16 at the lower part thereof, as shown by dashed lines in FIG. 1. Channel 15 can also be formed of the same co-extruded plastic material as used in panels 11 and in channel 12 and is attached to panel 11B so as to cover opening 16 therein. Channel 15 can also be heat-sealed to the lower portion of panel 11B as is channel 12, channel 15 forming a front opening 19. The opening 16 in panel 11B permits a portion of the air, which has been propelled into and is present within hemispherical structure 10, to exit from structure 10 through channel 15 and opening 19, the volume of air which is permitted to exit from front opening 19 of channel 15 being controllable by controlling the size of opening 19. Suitable control may be achieved by the weight of the material itself which forms the front opening. Alternatively, it may be achieved in any other appropriate manner, as by using one or more suitable weights 20 which, if desired, can be incorporated in the upper edge of the entrance opening 19. Such weight is appropriately selected in accordance with the size of the structure and the volume of air flow produced by fan 14 so as to maintain, when inflated, the desired hemispherical shape and the desired air circulation characteristics.

In addition to permitting the control of the volume of air that has been introduced into the chamber formed by panels 11, channel 15 provides an appropriate entry and exit means for the chamber so that individuals can enter and leave the inflatable structure in a convenient manner. The size of channel 15 and the sizes of openings 16 and 19 are designed appropriately for the purpose for which the inflatable structure is to be used.

Panels 11 may be of sufficient length to permit the lower portion thereof, when inflated, to be folded inwardly at the bottom of the chamber as shown at 17, an opening 18 being provided in the interior of the chamber for exposing the surface, such as a floor, on which the overall structure is positioned. By providing the opening 18, an emergency exit becomes available since individuals can readily lift the panel portions 17 from the floor surface and exit in any direction underneath any one of the panels, thereby avoiding a problem of crowding at entry/exit chamber 15 in the event the structure becomes deflated and an emergency exit for persons inside is required.

Figure 2:
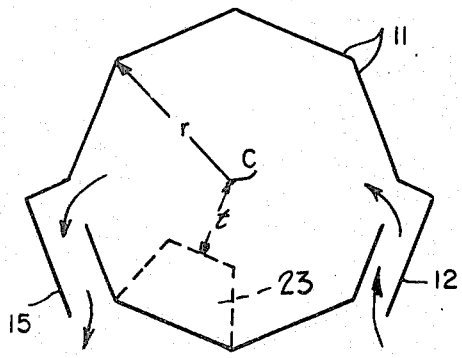
FIG. 2 shows a plan view of the structure shown in FIG. 1.

A plan view of the structure is shown in FIG. 2. Such plan view shows the flow of air from the exterior of the structure through channel 12 into the chamber to inflate the structure and, thence, outwardly through channel 15, as generally shown by the arrows therein.

In the use of such structure as a planetarium display apparatus, for example, it is desirable that, when inflated, the structure provides as true a hemispherical shape as can be obtained. While a reasonable number of panels is required for such purpose, the use of too many panels tends to increase the cost of fabrication. It has been found that the use of eight panels provides an excellent approximation to a hemispherical shape at a reasonable cost. Further increase in the number of panels does not appear to provide a much better approximation and for planetarium display use the structure of FIG. 1 using eight panels represents an economical usable chamber.

In order to provide a good approximation to a hemisphere, when inflated, the panels are preferably shaped in the manner shown in and discussed with reference to FIG. 3. As can be seen therein, each panel 11 comprises three portions, a dome portion 21, a skirt portion 22 and a base portion 23. Each panel has substantially the identical shape shown in FIG. 3 except that panels 11A and 11B, as discussed above, have suitable openings 13 and 16 therein, as exemplarily shown by dashed outline 24.

Figure 3:
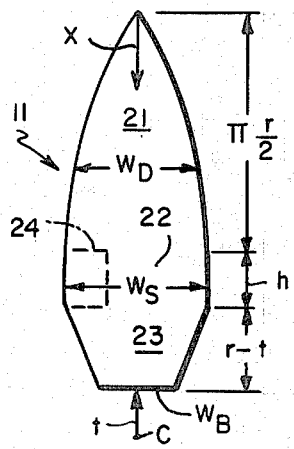
FIG. 3 shows an outline view of a panel for use in the structure of FIG. 1.

Dome 21 is of a generally arch-shape and forms, when inflated, a spherical triangle. A preferable shape therefor can be expressed in accordance with the following equation:

$$W_D 32\ 2r \tan \pi/s \sin x/r,$$

where the height of the dome is equal to $\pi r/2$, as shown in FIG. 3, $W_D$ is the width of the panel, r is the desired radius of the hemisphere (shown best, for example, in FIG. 2), s is the number of panels and x is the length of the dome as measured from the apex at the top of the panel (where $x=0$) to the base of the dome, the total length of the dome portion being equal to $\pi r/2$ as shown.

The skirt portion 22 has a rectangular shape, the height, h, thereof being selected for the purpose for which the structure is to be used. For example, for a classroom of students who would normally be sitting on the floor within the chamber the height of the skirt could be selected so that the top edge of the skirt, when inflated, is approximately at eye level with the average height of the seated student. The width Ws thereof is equal to the width of the lower edge of the skirt 22 and can be expressed as: $W_s=2r \tan \pi/s$.

The base portion 23 of the panel is trapezoidally shaped, the long side thereof adjacent the skirt having the same width as the skirt portion, while the short side has a width $W_B$ expressed by the formula: $W_B=2t \tan \pi/s$, where t is the distance from the center C of the hemisphere which is formed by the inflated chamber to the short side of the trapezoidal base, as shown in FIG. 3.

Figure 4A:
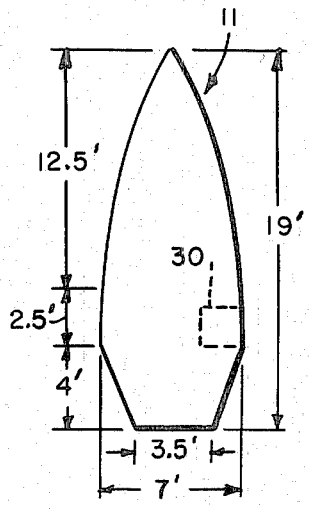
FIGS. 4A and 4B show outline views of specifically dimensioned panels and channels for use in a structure of the type shown in FIG. 1.
Figure 4B:
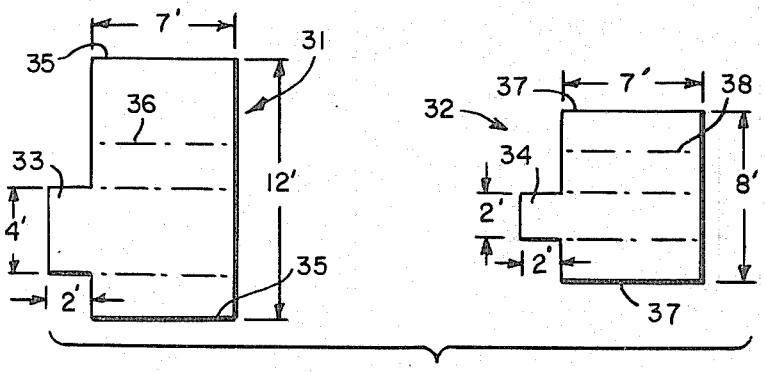

As an example of a particular structure fabricated in the above manner, a planetarium generally having a capacity of about 30 persons can be designed to provide a hemisphere having a radius of about 16 feet with an overall height of about 10.5 feet. Such a structure can utilize eight panels 11 having the dimensions shown in FIG. 4A, two of the panels having openings, an entry/exit opening shown by dashed line 30, for example, and a similar, but smaller, opening (not shown) for air entry. The channels used for air entry and for entrance/exit purposes can be formed as generally rectangular pieces 31 and 32 having rear enclosure tabs 33 and 34, respectively, in accordance with the dimensions shown in FIG. 4B. The channels can be formed as separate entities determined by the fold lines shown and heat sealed at seams 35 and 37, respectively. The channels, once formed, can be heat sealed to the appropriate panels along seams 35 and 37 and along fold lines 36 and 38, respectively. A relatively inexpensive, consumer-grade, 20-inch window fan made by any number of manufacturers known to the art can be utilized for the inflation of such chamber.

The panels and the channel pieces are made of co-extruded plastic sheets wherein the inner sheet which forms the inner wall of the chamber, when inflated, has a white surface, while the outer surface is black, the overall sheets being opaque. When such material is used for channels 12 and 15, the interior surfaces thereof can be the black surfaces so that any light which tends to enter either of the channels is generally absorbed by such black interior surfaces thereof. The dimensions shown in FIG. 3, FIG. 4A and FIG. 4B generally provide an entrance tube which is large enough for persons to walk through but is arranged with appropriate weights so as to permit the entrance opening 19 to sag down when not in use to further prevent light entry. Such action generally regulates the air flow out of the dome, the continuous air-flow system having the benefit of constant and relatively rapid ventilation of the chamber so as to eliminate the need for any additional air circulation equipment. The use of the air input channel and entrance/exit channel having generally curved shapes, as shown in FIG. 1, also tends to further prevent light entry, a major problem inherent in inexpensive planetariums. Since light entry through the air-input channel is thereby adequately prevented, the need for an expensive light-tight blower system is eliminated and an inexpensive, consumer-grade window fan, as discussed above, can be used.

When used as a planetarium the inner surfaces of the co-extruded plastic panels are used for projecting the planetarium display and forming concave surfaces which provide an overall ideal shape and a smooth textured surface for the purpose. The system is generally strong enough to take relatively rough handling by a user while at the same time, because of the lack of any rigid or semi-rigid components, it is substantially completely collapsible and extremely flexible so that it can be readily folded and compactly placed in a suitable storage container. The weight thereof is relatively light so that it can be easily handled by most persons, including children. The material can be of a fire-retardant nature, such as polyethylene plastic which burns relatively slowly, releasing non-toxic gases. Such plastics often can utilize additives which further reduce their flammability so that the overall structure will not readily support combustion.

The structure is particularly safe in that the relatively thick, co-extruded plastic does not conform to small objects so that it cannot get stretched over a person's mouth or nose, for example. Moreover, if there is a power loss, the structure deflates only very slowly, a structure of the size discussed in FIG. 4A and 4B, for example, taking about five minutes to reach a half-volume state under the most adverse conditions. Accordingly, the occupants of the chamber can easily leave by merely lifting up the base pieces and crawling out on any side of the flexible chamber. Moreover, exit can also be achieved through the entrance/exit channel in a few seconds. If approximately thirty persons are present in the chamber, accidental deflation will represent no danger since everyone in the chamber could exit in the above manners in a very short time.

when used as a planetarium, an appropriate planetarium projector 30 can be placed in the center thereof as shown in FIG. 1, such projectors being available to those in the art as described, for example, in the above-referenced Douthitt patent. One such projector may be presently purchased under the designation Nova Home Projector sold by Steven Manufacturing Company, Herman, Mo.

While the extensible material has been described as formed by a co-extrusion process, it can also be formed by the lamination of separate plastic sheets, or by any other process which will provide a material which is capable of serving as a projection screen and is opaque to light when used as a planetarium, for example.

Further, while the structure has been described as a planetarium, it is clear that such structure can be utilized for other purposes, both educational and recreational, for example. Thus the environment is ideal for showing slides or movies, as to a classroom. It can also be used as an isolation room for play, either in a school or home environment. For such purpose each of the panels may have a portion thereof made of clear plastic so that light can enter and those outside can inspect the activities taking place in the chamber. The clear portions of the panels may be placed at any desirable locations in one or more of the panels thereof.

The panel size can be varied in accordance with the desired use and such devices can be made relatively small for use by one or two persons, or by children, in a home environment as a play area, for example. In such instances it may be desirable to place appropriate designs on the inner or outer walls thereof to simulate a particular environment. For example, the outer wall may have designs to simulate the exterior of a tank while the inner wall has appropriate designs to simulate the interior thereof. Alternatively, for example, the exterior may have a design to resemble the exterior of a space ship while the interior has a design representing the interior thereof.

Accordingly, many other variations of such structures will occur to those in the art within the spirit and scope of the invention. Hence, the invention is not to be limited to the specific embodiments discussed herein except as set forth in the appended claims.

What is claimed is:

1. A self-supporting flexible structure comprising a chamber-forming assembly including a plurality of flexible panels made substantially entirely of extensible material capable of deformation into a concave shape, said panels being attached in a manner such that, when inflated, said assembly is capable of assuming a generally hemispherical shape;

a first one of said panels having a first opening therein;

a first channel means made substantially entirely of extensible material and attached to said first one of said panels to permit the introduction of air under pressure greater than atmospheric pressure through said first opening so as to inflate said assembly and to form a generally hemispherically shaped chamber;

a second one of said panels having a second opening therein;

a second channel means made substantially entirely of extensible material and attached to said second one of said panels to permit the exit from said chamber through said second opening of a controllable volume of air that has been so introduced into said chamber and further, when inflated, providing entry and exit means for said chamber.

2. A structure in accordance with claim 1 wherein each of said panels comprises a first portion having a generally triangular shape, a second portion having a generally rectangular shape, and a third portion having a generally trapezoidal shape.

3. A structure in accordance with claim 2 wherein said third portion of each of said panels forms a base portion capable of being folded inwardly into said chamber when said structure is inflated.

4. A structure in accordance with claim 3 wherein said first generally triangular portion has a height equal to $\pi r/2$ and a width equal to $2r \tan \pi/s \sin x/r$, where r is the radius of the hemisphere formed by said assembly when it assumes its generally hemispherical shape, s is the number of panels used in said structure, and x is the height of said triangular shape as measured from the apex to the base thereof.

5. A structure in accordance with claim 4 wherein said second portion has a rectangular shape having a preselected height and a width equal to 2r tan $\pi/s$.

6. A structure in accordance with claim 5 wherein said third portion has a trapezoidal shape having a first and second base, the height of said trapezoid being equal to (r-t), said first base width being equal to 2r tan $\pi/s$, and said second base width being equal to 2t tan $\pi/s$, where t is the distance from the center of said hemisphere to said second base.

7. A structure in accordance with claim 1 and further including fan means for supplying air to said first channel for the introduction of air through said first opening.

8. A structure in accordance with claim 7 wherein said second channel includes a front opening for permitting entry and exit into said channel from the exterior of said chamber, when inflated, and further including means for controlling the size of said front opening to control the volume of air that has been introduced into and is circulating through said chamber.

9. A structure in accordance with claim 1 wherein said extensible material is a plastic material having a thickness of less than 10 mil.

10. A structure in accordance with claim 9 wherein said thickness lies in a range from about 4 mil to about 6 mil.

11. A structure in accordance with claim 1 wherein said extensible material is in the form of co-extruded plastic sheet material.

12. A structure in accordance with claim 11 wherein at least one of said co-extruded plastic sheets is opaque to light.

13. A structure in accordance with claim 1 wherein said extensible material is in the form of laminated plastic sheet material.

14. A structure in accordance with claim 13 wherein said laminated plastic sheet material comprises two laminated sheets, at least one of which is opaque to light.

* * * * *